US009062949B1

(12) United States Patent
Clemen, Jr. et al.

(10) Patent No.: US 9,062,949 B1
(45) Date of Patent: Jun. 23, 2015

(54) APPARATUS, METHODS, AND SYSTEMS FOR ELECTROMAGNETIC PROJECTILE LAUNCHING

(71) Applicant: The Boeing Company, Seal Beach, CA (US)

(72) Inventors: Mark Joseph Clemen, Jr., Bremerton, WA (US); James A. Grossnickle, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 159 days.

(21) Appl. No.: 13/751,259

(22) Filed: Jan. 28, 2013

(51) Int. Cl.
*F41B 6/00* (2006.01)
*F42B 30/00* (2006.01)

(52) U.S. Cl.
CPC ..... *F42B 30/00* (2013.01); *F41B 6/006* (2013.01)

(58) Field of Classification Search
CPC ..... F41B 6/006; F41B 6/00; F41B 6/003
USPC ..... 89/8; 124/3
See application file for complete search history.

(56) References Cited

U.S. PATENT DOCUMENTS

| | | | | | |
|---|---|---|---|---|---|
| 3,589,300 | A * | 6/1971 | Wipf | 104/281 |
| 3,951,070 | A * | 4/1976 | Flatau et al. | 102/502 |
| 4,190,476 | A * | 2/1980 | Flatau et al. | 156/218 |
| 4,638,739 | A * | 1/1987 | Sayles | 102/520 |
| H357 | H * | 11/1987 | Howland et al. | 89/8 |
| 4,813,332 | A * | 3/1989 | Jasper, Jr. | 89/8 |
| 4,858,511 | A * | 8/1989 | Jasper, Jr. | 89/8 |
| 4,901,621 | A * | 2/1990 | Tidman | 505/164 |
| 4,930,395 | A * | 6/1990 | Loffler | 89/8 |
| 4,961,366 | A * | 10/1990 | Kemeny | 89/8 |
| 4,966,884 | A * | 10/1990 | Hilal | 505/164 |
| 5,017,549 | A * | 5/1991 | Robertson | 505/164 |
| 5,076,136 | A * | 12/1991 | Aivaliotis et al. | 89/8 |
| 5,237,904 | A * | 8/1993 | Kuhlmann-Wilsdorf | 89/8 |
| 5,483,863 | A * | 1/1996 | Dreizin | 89/8 |
| 6,182,943 | B1 * | 2/2001 | Steinruck et al. | 251/129.16 |
| 6,413,624 | B1 * | 7/2002 | Tomita et al. | 428/306.6 |
| 7,444,919 | B1 * | 11/2008 | Mansfield | 89/8 |
| 7,503,249 | B2 * | 3/2009 | Jackson et al. | 89/8 |
| 7,634,989 | B2 * | 12/2009 | Ignatiev | 124/3 |
| 7,750,524 | B2 * | 7/2010 | Sugimoto et al. | 310/162 |
| 7,830,047 | B2 * | 11/2010 | Putman et al. | 310/12.07 |
| 8,132,562 | B1 * | 3/2012 | Perkinson, Jr. | 124/3 |
| 8,237,526 | B2 * | 8/2012 | Putman et al. | 335/219 |
| 8,322,265 | B1 * | 12/2012 | Singer | 89/8 |
| 8,701,539 | B1 * | 4/2014 | Dreizin et al. | 89/8 |
| 8,701,639 | B2 * | 4/2014 | Proulx | 124/3 |
| 2002/0132738 | A1 * | 9/2002 | Nagashima et al. | 505/100 |
| 2004/0255767 | A1 * | 12/2004 | Frasca | 89/8 |

(Continued)

OTHER PUBLICATIONS

Aubuchon, M.S., et al, "Study of Coilgun Performance and Comments on Powered Armatures," Power Modulator Symposium 2004, pp. 141-444.

Kaye, Ronald J., "Operational Requirements and Issues for Coilgun Electromagnetic Launchers," IEEE Transactions on Magnetics, vol. 41, No. 1, Jan. 2005, pp. 194-199.

Gherman, Laurian, et al., "Induction Coilgun Based on "E-Shaped" Design," IEEE Transactions on Plasma Science, vol. 39, No. 2, Feb. 2011, pp. 725-729.

(Continued)

*Primary Examiner* — Joshua Freeman
(74) *Attorney, Agent, or Firm* — Armstrong Teasdale LLP

(57) ABSTRACT

Apparatus, methods, and systems for electromagnetic projectile launching are described. In one example, a projectile for use with an electromagnetic launcher includes an armature configured to couple to a payload and configured for acceleration by the electromagnetic launcher. The armature includes a superconductor material.

16 Claims, 5 Drawing Sheets

(56) References Cited

U.S. PATENT DOCUMENTS

| | | | | |
|---|---|---|---|---|
| 2005/0099253 | A1* | 5/2005 | Bock et al. | 335/100 |
| 2006/0027084 | A1* | 2/2006 | Schneider | 89/8 |
| 2008/0053299 | A1* | 3/2008 | Taylor | 89/8 |
| 2009/0173328 | A1* | 7/2009 | Skurdal et al. | 124/3 |
| 2011/0246028 | A1* | 10/2011 | Lisseman et al. | 701/45 |
| 2014/0060508 | A1* | 3/2014 | Floyd et al. | 124/3 |

OTHER PUBLICATIONS

Turman, B.N., et al. "EM Mortar Technology Development for Indirect Fire," Sandia National Lab Report, Nov. 1, 2006.

Lockner, Thomas R., et al., "Coilgun Technology, Status, Applications, and Future Directions at Sandia National Laboratories," Power Modulator Symposium 2004, pp. 119-121.

* cited by examiner

APPARATUS, METHODS, AND SYSTEMS FOR ELECTROMAGNETIC PROJECTILE LAUNCHING

BACKGROUND

The field of the disclosure relates generally to electromagnetic projectile launching, and more particularly, to apparatus, methods and systems for electromagnetic projectile launching.

Known electromagnetic launching systems generally utilize an electromagnetic force, particularly the Lorentz force, to accelerate and launch a projectile. Two common types of electromagnetic launch systems are railguns and coilguns.

In a typical railgun system, a launch package slides between a pair of generally parallel rails. The launch package includes a payload coupled to an armature that functions as a sliding switch or an electrical short between the rails. In at least some known systems, launch packages include a sabot. By passing a large electrical current through one rail, through the armature, and back along the other rail, a large magnetic field is generated behind the launch package. The rapidly changing magnetic field within the boundaries of the two rails accelerates the launch package to a high velocity accordingly.

Electromagnetic coilgun systems include one or more electrical coils. In some systems, the coils surround a barrel. A launch package, including a payload and an armature, is positioned within the barrel. In other systems, the coils do not surround a barrel and the payload and/or armature surrounds the coils. In either type of system, when the electrical coils are energized, magnetic fields are generated along the length of the coilgun. In multi-coil coilguns, sequentially switching the electrical coils produces a wave of magnetic energy that travels along the length of the coilgun. Some coilguns push the launch package down the length with a magnetic field behind the package, while others both push and pull the launch package (referred to as push-pull) by selectively energizing coils on opposite ends of the launch package.

Both railguns and coilguns include an armature in the launch package. The armature is the portion of the launch package upon which electromagnetic forces act. In various systems, the armature is a separate item coupled to or integrated within a payload, is the payload itself, and/or is a sabot coupled to a payload. The design and operation of the armature for a railgun and a coilgun differs. However, in both types of electromagnetic launching system, the system acts on the armature to propel the launch package. The armatures are typically made from an electrically conductive material, such as iron, steel, copper, aluminum, etc. In some types of coilgun systems, the armature is generally a non-ferromagnetic material, such as copper or aluminum.

BRIEF DESCRIPTION

In one aspect of the present disclosure, a projectile for use with an electromagnetic launcher is provided that includes an armature including a superconductor material. The armature is configured for coupling to a payload and configured for acceleration by the electromagnetic launcher.

In another aspect of the present disclosure, a method is provided for use in making a projectile for an electromagnetic launcher. The method includes providing an armature including a superconductor material configured for coupling to a payload and configured for acceleration by an electromagnetic launcher. The method includes cooling the armature to at least a temperature at which the superconducting material enters a superconducting state.

In a further aspect of the present disclosure, an armature for use with an electromagnetic launcher is provided. The armature includes a superconductor material having a toroidal shape, and a reinforcement material wrapped about the superconductor material.

DETAILED DESCRIPTION

As used herein, an element or step recited in the singular and proceeded with the word "a" or "an" should be understood as not excluding plural elements or steps unless such exclusion is explicitly recited. Furthermore, references to "one embodiment", "one implementation", the "exemplary embodiment" or the "exemplary implementation" are not intended to be interpreted as excluding the existence of additional embodiments or implementations that also incorporate the recited features.

The exemplary apparatus, methods, and systems described herein relate generally to electromagnetic projectile launching. More particularly, the exemplary implementations relate to superconducting armatures for electromagnetic projectile launching.

Figure 1:
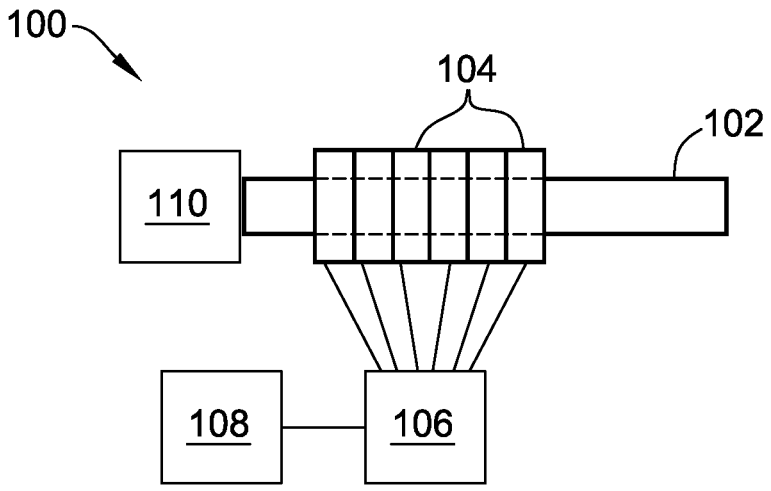
FIG. 1 is a simplified block diagram of an exemplary electromagnetic launch system.

FIG. 1 is a simplified block diagram of an exemplary electromagnetic launch system 100. In the exemplary implementation, system 100 is a push-pull coilgun system. In other implementations, system 100 is a push only coilgun, a rail gun, and/or any other suitable electromagnetic launch system. System 100 includes a barrel 102 that includes a plurality of coils 104 wrapped around barrel 102. A control system 106 selectively couples coils 104 to a source 108 of electrical current. In other implementations, more than one source 108 may be used. In some implementations source 108 includes at least one capacitor bank. In the exemplary implementation, system 100 achieves a ten megajoule (MJ) intermediate muzzle energy. In other implementations, system 100 achieves greater or lesser intermediated muzzle energies, for example about 100 kJ, about 500 kJ, about 1 MJ, about 20 MJ, or about 90 MJ. In the exemplary implementation a five kilogram (kg) projectile is accelerated to a muzzle velocity of about three kilometers (km) per second (s). In other implementations, system 100 accelerates a five gram projectile to a muzzle velocity of about 15 km/s. In still other implementations, system 100 accelerates a projectile of between one and ten grams to muzzle velocities between 5 km/s and 10 km/s.

System 100 includes a cooler 110 that reduces the temperature of a superconducting armature (not shown in FIG. 1) to and/or below a temperature at which the superconducting material used in fabricating the armature is transitioned to a superconducting state. Moreover, in the exemplary implementation, cooler 110 traps a magnetic flux in the superconducting material of the armature. Cooler 110 generates a magnetic field through the superconducting material of the armature as the material is being cooled to the transition temperature. Thus, cooler 110 cools, in the presence of a magnetic field, the armature to at least the temperature at which the superconducting material of the armature becomes superconducting. Superconductors have a flux-trapping property such that a magnetic flux will be trapped in the superconductor if it is present when the material crosses the temperature threshold between conducting and superconducting states, sometimes referred to as the "critical temperature". Moreover, once the superconductor material becomes superconducting, the superconductor will reject any further imposition of magnetic flux. This property is referred to as flux-exclusion.

The aforementioned two properties of superconductors enable superconductors to function as powerful artificial magnets and facilitate efficient acceleration in an electromagnetic launch system. In other implementations, cooler 110 does not generate a magnetic flux, and the armature is transitioned to a superconducting state without a trapped magnetic flux. In still other implementations, system 100 does not include cooler 110, and the superconducting armature is loaded into system 100 already cooled, with or without a trapped magnetic flux, to the superconducting state by a different system. In the exemplary implementation, the superconducting material of the armature has a trapped magnetic field, whether generated by cooler 110 or by another system, of about ten teslas (T). In other implementations, magnetic fields of greater or lesser magnitude may be trapped in the superconducting material of the armature.

Figure 2:
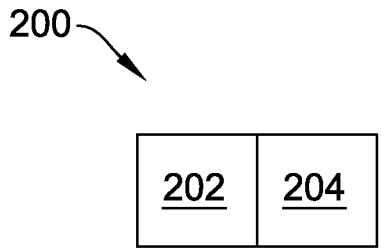
FIG. 2 is a simplified block diagram of an exemplary projectile package that may be used with the launch system shown in FIG. 1.

FIG. 2 is a simplified block diagram of an exemplary projectile package 200 for use with system 100 (shown in FIG. 1). Projectile package 200 includes an armature 202 and a payload 204. Armature 202 is coupled to payload 204 and is configured for acceleration by system 100. In the exemplary implementation, armature 202 is attached externally to payload 204. In other implementations, armature 202 may be integrated with payload 204. In still other embodiments, armature 202 is the payload (i.e., the armature is being launched by system 100 without a separate payload 204). Moreover, in some implementations armature 202 is permanently (or semi-permanently) attached to payload 204, i.e., armature 202 launches from system 100 and is delivered to a target with payload 204. In other implementations, armature 202 is removably coupled to payload 204 and is detached from payload 204 when payload 204 leaves barrel 102 or shortly thereafter. Thus, in some implementations, armature 202 remains with system 100 after payload 204 is launched from barrel 102, while in other implementations, armature 202 is the payload (i.e., the armature is being launched by system 100 without a separate payload 204). In some embodiments, armature 202 is a sabot.

Figure 3:
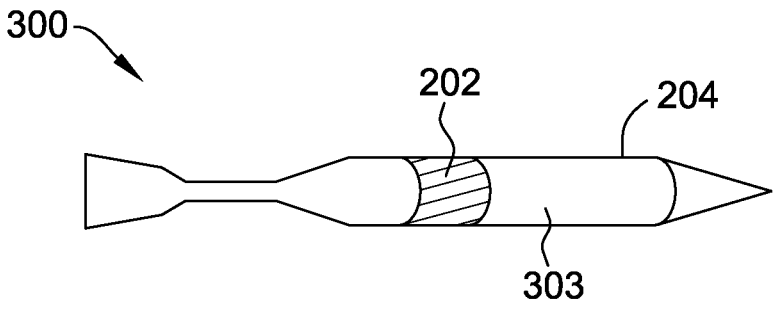
FIG. 3 is an alternative projectile package that may be used with the launch system shown in FIG. 1.

FIG. 3 is another exemplary projectile package 300 that may be used with system 100. Projectile package 300 includes armature 202 and payload 204. In this implementation, payload 204 is a mortar round and armature 202 is integrated into the round. Armature 202 forms a portion of an outer surface 303 (e.g., housing, casing, etc.) of payload 204. In other implementations, armature 202 may be integrated within payload 204 by being positioned entirely within a housing, caring, enclosure, etc. of payload 204.

Armature 202 is fabricated from a superconductor material. In the exemplary implementation, the superconductor material is a bulk, single-crystal high temperature superconductor (HTSC). In some implementations, armature 202 is yttrium barium copper oxide. In other implementations, the superconductor material is bismuth strontium calcium copper oxide. In still other implementations, armature 202 is fabricated from any other suitable superconductor material.

Armature 202 is configured for acceleration and launching by system 100. Armature 202 is sized and shaped to fit within barrel 102. More specifically, armature 202 is configured to withstand the significant shear and radial pressures during acceleration and launch of armature 202 by system 100. In some implementations, the shear stress on armature 202 has a peak value of about $10^8$ pascals (Pa) and a peak radial stress of about $2\times10^6$ Pa. The shape of armature 202 is selected to facilitate withstanding the acceleration and launch pressures generated on armature 202 by system 100. The shape of armature 202 may be any shape suitable for acceleration and launch by system 100.

Figure 4:
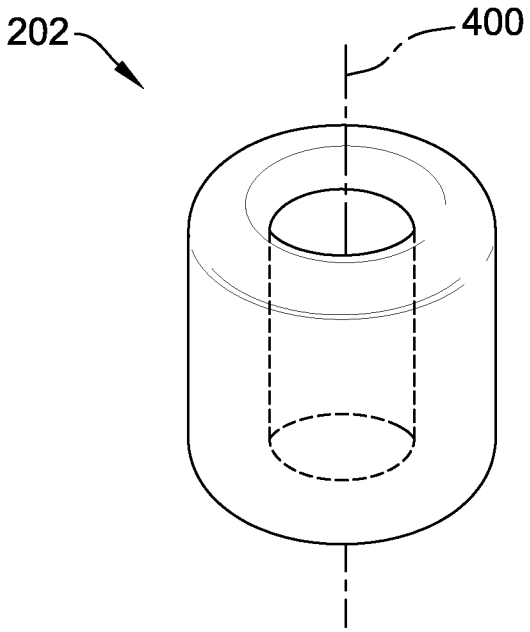
FIG. 4 is an isometric view of an exemplary implementation of an elongated toroid shaped armature.
Figure 5:
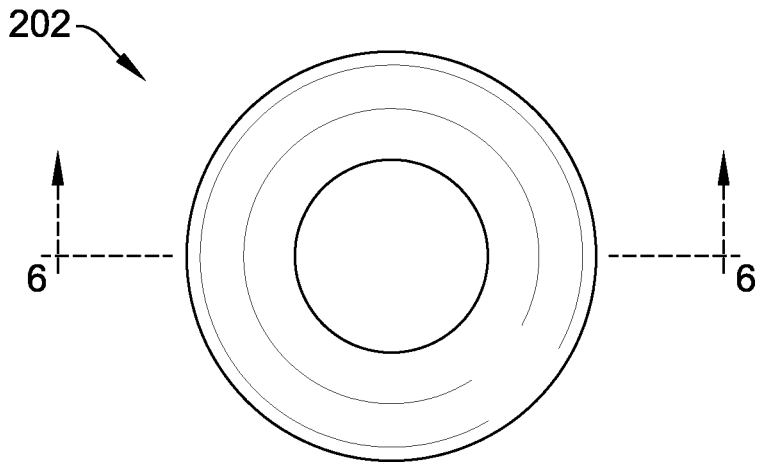
FIG. 5 is a top plan view of the armature shown in FIG. 4.
Figure 6:
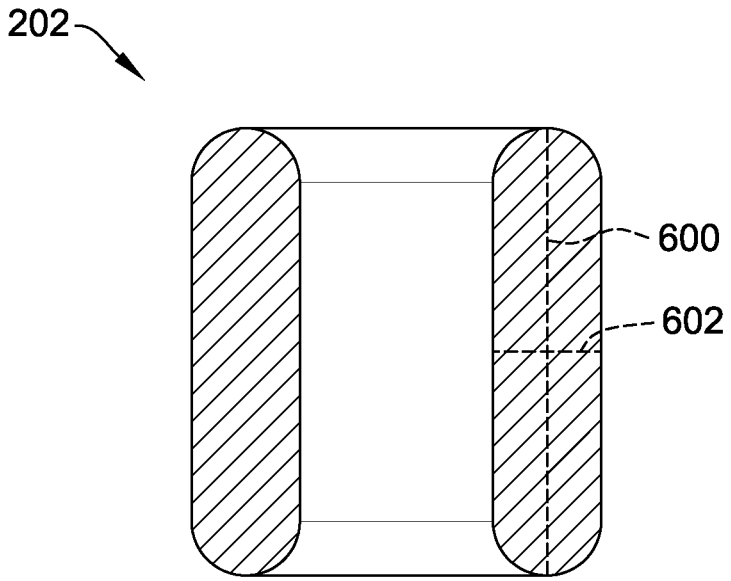
FIG. 6 is a cross sectional view of the armature shown in FIG. 4.
Figure 7:
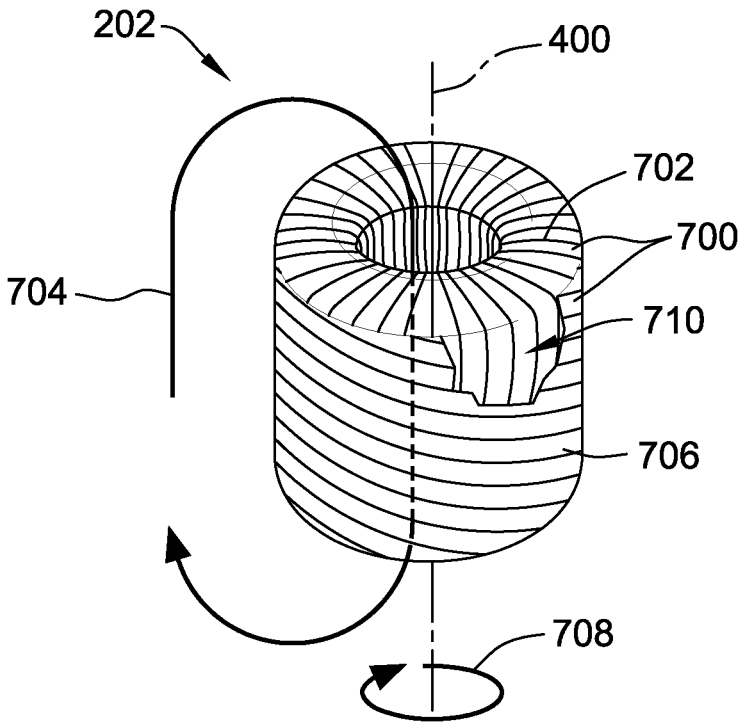
FIG. 7 is an isometric view of the armature shown in FIG. 4 including reinforcing material.

FIG. 4 is an isometric view of an elongated toroidally-shaped armature 202. FIG. 5 is a top plan view of armature 202 shown in FIG. 4. FIG. 6 is cross sectional view of armature 202 shown in FIG. 4. FIG. 7 is an isometric view of armature 202 and including reinforcing material.

In the implementation shown in FIGS. 4-7, armature 202 is an elongated toroid-shaped armature. More specifically, Armature 202 defines a central axis 400 and is substantially symmetrical about a central axis 400. As shown in FIG. 6, armature 202 has an elongated cross section with semicircular ends. The cross section includes a first axis 600 and a second axis 602. First axis 600, also referred to as a long axis, is longer than second axis 602 and extends generally perpendicular to central axis 400. Second axis 602, also referred to as a short axis, is substantially perpendicular to first axis 600 and central axis 400. In other implementations, armature is 202 may be any other suitable shape including, for example, a cylindrical solid, an elliptical solid, or an elliptical torus.

As shown in FIG. 7, armature 202 is reinforced with a reinforcing material 700. Reinforcing material 700 is selected and applied to facilitate withstanding the shear and radial pressures experienced by armature 202 during acceleration and launching of armature 202 by system 100. In the exemplary implementation, reinforcing material 700 is carbon fiber. Two different windings of carbon fiber material are applied to armature 202. A first winding 702 is a helical winding of carbon fiber around armature 202. First winding 702 is wound around armature 202 in first direction 704. A second winding 706 is a hoop winding of carbon fiber around armature 202 in direction 708. In FIG. 7, a portion 710 of second winding 706 is cutaway to show first winding 702. In other implementations, any other suitable reinforcing material, or combination of materials, may be utilized, more or fewer windings of reinforcing material may be utilized, and/or different windings of reinforcing material may be utilized.

Figure 8:
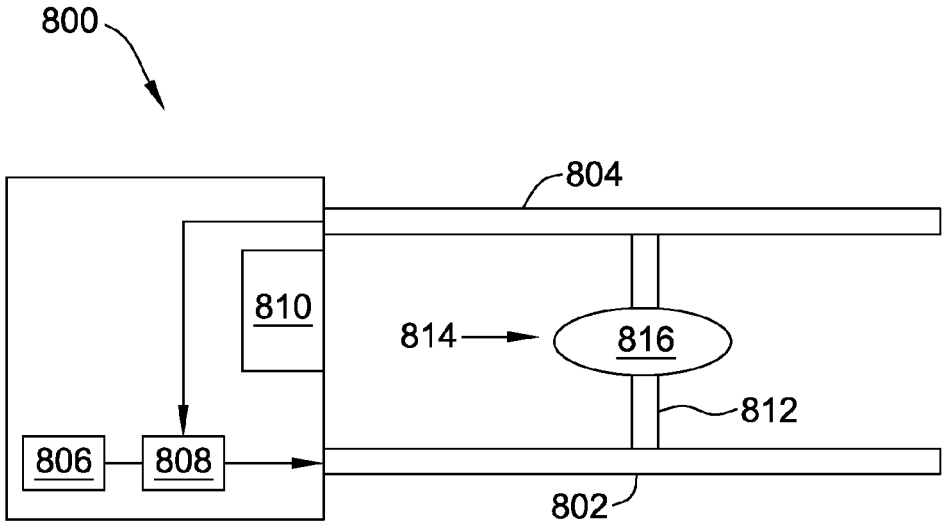
FIG. 8 is a simplified diagram of another exemplary electromagnetic launch system.

FIG. 8 is a simplified diagram of another exemplary electromagnetic launch system 800. In the exemplary implementation, system 800 is a rail gun system. In other implementations, system 800 is any other suitable electromagnetic launch system. System 800 includes two rails 802 and 804. A control system 806 couples a source 808 of electrical current to rails 802. In other implementations, more than one source 808 may be used. In some implementations source 808 includes at least one capacitor bank. In the exemplary implementation, system 800 achieves a ten MJ intermediate muzzle energy. In other implementations, system 800 achieves greater or lesser intermediated muzzle energies, for example about 100 kJ, about 500 kJ, about 1 MJ, about 20 MJ, or about 90 MJ. In the exemplary implementation a five kilogram (kg) projectile is accelerated to a muzzle velocity of about three kilometers (km) per second (s). In other implementations, system 800 accelerates a five gram projectile to a muzzle velocity of about 15 km/s. In still other implementations, system 100 accelerates a projectile of between one and ten grams to muzzle velocities between 5 km/s and 10 km/s.

System 800 includes a cooler 810 that reduces the temperature of a superconducting armature 812 to and/or below a temperature at which the superconducting material used in fabricating armature 812 is transitioned to a superconducting state. Moreover, in the exemplary implementation, cooler 810 generates a magnetic field through the superconducting material of the armature as the material is being cooled to the transition temperature. Superconductors have a flux-trapping property such that a magnetic flux will be trapped in the superconductor if it is present when the material crosses the temperature threshold between conducting and superconducting states, sometimes referred to as the "critical temperature". Moreover, once the superconductor material becomes superconducting, the superconductor will reject any further imposition of magnetic flux. This property is referred to as flux-exclusion. In other implementations, cooler 810 does not generate a magnetic flux, and the armature 812 is transitioned to a superconducting state without a trapped magnetic flux. In still other implementations, system 800 does not include cooler 810, and the superconducting armature 812 is loaded into system 800 already cooled, with or without a trapped magnetic flux, to the superconducting state by a different system. In the exemplary implementation, the superconducting material of the armature has a trapped magnetic field, whether generated by cooler 810 or by another system, of about ten teslas (T). In other implementations, magnetic fields of greater or lesser magnitude may be trapped in the superconducting material of the armature.

An exemplary projectile package 814 includes armature 812 and a payload 816. Armature 812 is coupled to payload 816 and is configured for acceleration by system 800. In the exemplary implementation, armature 812 is attached externally to payload 816. In other implementations, armature 812 may be integrated with payload 816. In still other embodiments, armature 812 is the payload (i.e., the armature is being launched by system 800 without a separate payload 816). Moreover, in some implementations armature 812 is permanently (or semi-permanently) attached to payload 816, i.e., armature 812 launches from system 800 and is delivered to a target with payload 816. In other implementations, armature 812 is removably coupled to payload 816 and is detached from payload 816 when payload 816 leaves rails 802 and 804 or shortly thereafter. In some embodiments, armature 812 is a sabot attached to payload 816.

Armature 812 completes an electrical circuit between rails 802 and 804. In operation, controller 806 couples current from source 808 to rails 802 and 804. Electrical current flows down rail 802, through armature 812, and returns through rail 804. This current creates a magnetic field inside the loop formed by the length of rails 802 and 804 up to the position of armature 812. Because the current is in the opposite direction along each rail 802 and 804, the net magnetic field between the rails is directed at right angles to the plane formed by the central axes of the rails 802 and 804 and armature 812. This produces, in combination with the current, a Lorentz force which accelerates armature 812 along the rails 812

The exemplary methods and systems described herein provide highly efficient electromagnetic launch systems and projectiles. An armature constructed from superconducting material operates more efficiently than similar armatures constructed of non-superconducting systems. Magnetic field strengths much greater than those attainable using non-superconducting materials may be obtained by using superconducting armatures. Moreover, efficiency increases may also be obtained by trapping a magnetic field in the superconducting material of the armature. Wrapping the superconducting armature with reinforcing material facilitates increasing the stability and strength of the superconducting material. Armatures configured in accordance with the present disclosure may be shaped to withstand the shear and tensile stresses induced on the armature during acceleration by an electromagnetic launching system. The described implementations permit simple launching using push only systems with pulsed magnetic fields. Strong trapped magnetic fields permit high velocities with shorter barrel lengths, more efficient magnetic coupling, and lower pulsed power requirements than in systems using other known magnetic materials.

The description of the different advantageous embodiments has been presented for purposes of illustration and description, and is not intended to be exhaustive or limited to the embodiments in the form disclosed. Many modifications and variations will be apparent to those of ordinary skill in the art. Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated. This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A projectile for use with an electromagnetic launcher, said projectile comprising:

an armature configured to couple to a payload and configured for acceleration by the electromagnetic launcher, said armature comprising a superconductor material and a reinforcement material wrapped about said armature, wherein said reinforcement material comprises a first winding wrapped about said armature in a first direction and a second winding wrapped about said armature in a second direction.

2. A projectile in accordance with claim 1, wherein said reinforcement material comprises a carbon fiber material.

3. A projectile in accordance with claim 1, wherein said armature is configured for acceleration by an electromagnetic coilgun.

4. A projectile in accordance with claim 1, wherein said armature is configured for acceleration by an electromagnetic railgun.

5. A projectile in accordance with claim 1, wherein said armature is configured for integration within the payload.

6. A projectile in accordance with claim 1, further comprising a payload coupled to said armature.

7. A projectile in accordance with claim 1, wherein said armature comprises an elongated toroidally-shaped armature.

8. A projectile in accordance with claim 1, wherein said superconductor material comprises a high temperature superconductor.

9. A projectile in accordance with claim 1, wherein a magnetic field is trapped within said superconductor material.

10. A method for making a projectile for an electromagnetic launcher, said method comprising:

providing an armature comprising a superconductor material configured to couple to a payload and configured for acceleration by an electromagnetic launcher;

wrapping a reinforcement material around the armature, wherein the reinforcement material includes a first winding wrapped about the armature in a first direction and a second winding wrapped about the armature in a second direction; and cooling the armature to at least a temperature at which the superconducting material enters a superconducting state.

11. A method in accordance with claim 10, further comprising trapping a magnetic flux in the superconductor material.

12. A method in accordance with claim 11, wherein trapping a magnetic flux in the superconductor material comprises cooling, in the presence of a magnetic field, the armature to at least the temperature at which the superconducting material becomes superconducting.

13. A method in accordance with claim 10, wherein providing an armature comprising a superconductor material configured for coupling to a payload and configured for acceleration by an electromagnetic launcher comprises providing an armature comprising a superconductor material having an elongated toroidal shape.

14. An armature for use with an electromagnetic launcher, said armature comprising:

a superconductor material having an elongated toroidal shape; and a reinforcement material wrapped about said superconductor material, wherein said reinforcement material comprises a first winding wrapped about said superconductor in a first direction and a second winding wrapped about said superconductor in a second direction.

15. An armature in accordance with claim 14, wherein said superconductor material has an elongated toroidal shape, the elongated toroidal shape defining a central axis about which the elongated toroidal shape is substantially symmetrical, a cross section of said superconductor material having an elliptical shape including a long axis and a short axis, the long axis extending substantially perpendicular to the central axis.

16. An armature in accordance with claim 14, wherein said reinforcement material comprises a carbon fiber material.

* * * * *